United States Patent [19]

Nakayama et al.

[11] 4,150,538

[45] Apr. 24, 1979

[54] DIAL ATTACHING DEVICE FOR WATCH

[75] Inventors: Yasuaki Nakayama, Hanno; Ryuzo Tanaka, Tanashi, both of Japan

[73] Assignee: Citizen Watch Company Limited, Tokyo, Japan

[21] Appl. No.: 849,623

[22] Filed: Nov. 8, 1977

[51] Int. Cl.[2] ..... G04B 37/00; G04B 37/04; G04B 19/06

[52] U.S. Cl. ..... 58/88 R; 58/55; 58/94; 58/127 B

[58] Field of Search ..... 58/52–55, 58/88 R, 94, 104, 127 R, 127 B

[56] References Cited

U.S. PATENT DOCUMENTS

| | | | |
|---|---|---|---|
| 1,310,523 | 7/1919 | Eberhard | 58/127 B |
| 1,708,293 | 4/1929 | Fitch | 58/127 B |
| 3,668,865 | 6/1972 | Hirabayashi | 58/127 B |

FOREIGN PATENT DOCUMENTS

| | | | |
|---|---|---|---|
| 125036 | 4/1927 | Switzerland | 58/127 B |
| 368750 | 5/1963 | Switzerland | 58/127 B |

*Primary Examiner*—Edith S. Jackmon
*Attorney, Agent, or Firm*—Sherman & Shalloway

[57] ABSTRACT

A dial attaching device for use in watches with a movement holder ring functioning as a member for fixing a foot of a dial to a base plate and as a member for connecting the base plate to a watch case. The movement holder ring is made of synthetic resin and completely fixes the foot of the dial to the base plate therethrough by characteristics of synthetic resin.

2 Claims, 3 Drawing Figures

DIAL ATTACHING DEVICE FOR WATCH

BACKGOUND OF THE INVENTION

1. Field of the Invention

This invention relates to a dial attaching device for use in watches.

2. Description of the Prior Art

Heretofore there have been proposed dial attaching devices to secure a dial to a watch movement as shown in FIG. 1. In the drawing, reference numeral 1 depicts a base plate which is enclosed by a windshield 7, a back cover 8 and watch case 9. The base plate 1 is connected to the watch case 9 by means of a receiving ring 5 for defining a space between the upper face of the base plate 1 and lower face of a dial 2. There is provided a movement holder ring 4 between the base plate 1 and the watch case 9. Reference numeral 6 denotes a packing for watchproof etc.

The base plate 1 has a plurality of through holes 1*a* for receiving feet 2*a* of the dial 2. The base plate 1 has a threaded hole at its side through which a screw 3 is inserted to fix the feet 2*a* to the inside of said hole l*a*. Therefore the prior art device has defects that at least two through holes l*a* have to be formed on the base plate 1 and tapped holes are required through which screw 3 are inserted to fix the feed 2*a* of the dial 2 in the holes 1*a*. As the result, number of components for a dial attaching device is increased.

On the other hand, when adhesive material is used in place of the fixing screw 3, there occurs such an inconvenience that adhesive force deteriorates after the lapse of the time to loosen the fixture of the dial foot 2*a*. As the result, conventional dial attaching device is troublesome in assembling and high in cost.

SUMMARY OF THE INVENTION

A primary object of the invention is to provide a dial attaching device in which the conventional shortcomings are obviated.

Another object of the invention is to provide a dial attaching device which is reduced in its size, especially of the diametrical direction.

Other object of the invention is to provide a dial attaching device which is easy in assembling.

Further other object of the invention is to provide a dial attaching device in which the number of components to fix the dial to an amount is decreased.

Further other object of the invention is to provide a dial attaching device in which there is completely maintained the fixing structure of the dial to the movement in spite of the lapse of the time.

Further other object of the invention is to provide a dial attaching device which is low in cost.

According to one aspect of the invention there is provided a dial attaching device which comprises a base plate having a recess, a watch case housing the base plate, a movement holder ring made of synthetic resin intermediating between the base plate and the watch case, the movement holder ring having a protrusion a dial provided with a plurality of feet and mounted through movement holder ring on the base plate, a plurality of through holes formed on the movement holder ring and therethrough the dial feet being inserted to be fixed.

DETAILED DESCRIPTION OF PREFERRED EMBODIMENT

Figure 1:
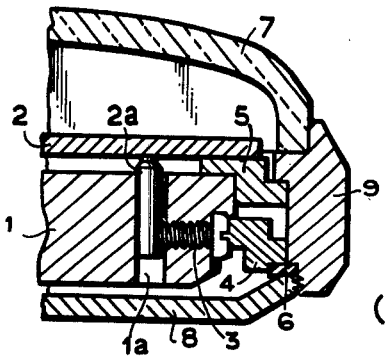
FIG. 1 (PRIOR ART)
FIG. 1 is a partial and sectional view showing a conventional dial attaching device for use in a watch.
Figure 2:
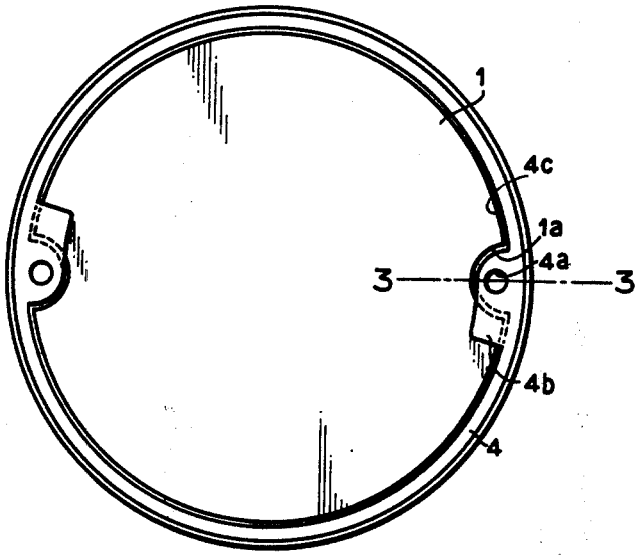
FIG. 2 is a plan view of a dial attaching device showing an embodiment according to our invention.
Figure 3:
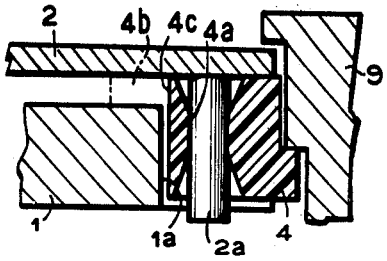
FIG. 3 is a partial and sectional view along line 3—3 in FIG. 2.

Hereinafter there will be decribed one embodiment of this invention with reference to the accompaning drawing. In FIGS. 2 and 3 like references are used to illustrate like parts in FIG. 1. Reference numeral 1 depicts a base plate, e.g. a substrate for a movement on which two recesses 1*a* are formed. There is provided a movement holder ring 4 between a watch case 9 and the base plate 1. The movement holder ring 4 has two holes 4*a* tightly fixing the dial feet 2*a* when inserted therein, a protrusion 4*b* defining the location of the height of the dial 2, and a protrusion 4*b* idly inserted into the recess 1*a* on the base plate 1. It is very important that the movement holder ring 4 is made of synthetic resin. The upper portion of the hole 1*a* has a taper portion 4*d* to easily guide the top of the dial foot 2*a*.

According to the above described structure of the dial attaching device, the movement holder ring 4 serves to fix the dial to the movement as well as to connect the movement to the watch case 9. Namely the foot 2*a* of the dial 2 is firmly and tightly fixed to the hole 4*a* in the movement holder ring 4 made of synthetic resin. Because this complete fixture is effected by characteristics of snythetic resin, i.e. flexibility and confined inside diameter of the hole 4*a*.

In addition the movement holder ring 4 is precisely located adjacent the dial foot 2*a* of the base plate 1 such as substrate because of precise arrangement of the recess 1*a* and protrusion 4*c* and as the result, the dial 2 being precisely attached to the movement.

According to the invention, a small space enables the fixture of the dial, low cost, and variety of size and shape for the dial, and as the result being capable of applying this invention to general timepieces.

What is claimed is:

1. A dial attaching device for use in a watch comprising:

(a) a base plate having a recess;

(b) a watch case housing said base plate;

(c) a movement holder ring made of synthetic resin intermediating between said base plate and said watch case, said movement holder ring having a protrusion;

(d) a dial provided with a plurality of feet and mounted through said movement holder ring on said base plate; and (e) a plurality of through holes formed on said movement holder ring and therethrough said dial feet being inserted to be fixed.

2. A dial attaching device for use in a watch according to claim 1, wherein said through hole has a slant surface at its inner and top edge for guiding said feet of said dial therein.

* * * * *